US006158366A

United States Patent [19]

Codos

[11] Patent Number: 6,158,366

[45] Date of Patent: Dec. 12, 2000

[54] PRINTING AND QUILTING METHOD AND APPARATUS USEFUL FOR AUTOMATED MULTI-NEEDLE QUILTING AND PRINTING ONTO WEBS

[75] Inventor: Richard N. Codos, Warren, N.J.

[73] Assignee: L&P Property Management Company, South Gate, Calif.

[21] Appl. No.: 09/480,094

[22] Filed: Jan. 10, 2000

Related U.S. Application Data

[63] Continuation-in-part of application No. 09/250,352, Feb. 16, 1999, Pat. No. 6,012,403, which is a continuation-in-part of application No. 09/070,948, May 1, 1998, Pat. No. 5,873,315.

[51] Int. Cl.[7] ..... D05B 11/00; D05B 21/00

[52] U.S. Cl. ..... 112/117; 112/306; 112/318; 112/470.05; 112/475.02; 112/475.08; 112/475.19; 101/35

[58] Field of Search ..... 112/117, 118, 112/119, 470.05, 470.12, 470.13, 470.06, 470.33, 304, 306, 307, 314, 318, 320, 322, 475.02, 102.5, 475.03, 475.04, 475.05, 475.08; 101/35

[56] References Cited

U.S. PATENT DOCUMENTS

| | | | |
|---|---|---|---|
| 3,611,961 | 10/1971 | Lopez et al. . | |
| 3,960,095 | 6/1976 | Story . | |
| 4,748,920 | 6/1988 | Stutznacker . | |
| 4,785,750 | 11/1988 | Best . | |
| 4,860,675 | 8/1989 | Brower et al. . | |
| 4,953,485 | 9/1990 | Brower et al. . | |
| 5,018,416 | 5/1991 | Freermann . | |
| 5,022,323 | 6/1991 | Schultheis . | |
| 5,040,473 | 8/1991 | Zesch et al. . | |
| 5,095,835 | 3/1992 | Jernigan et al. . | |
| 5,099,773 | 3/1992 | Codos . | |
| 5,144,899 | 9/1992 | Allen . | |
| 5,154,130 | 10/1992 | Gribetz et al. . | |
| 5,159,874 | 11/1992 | Adamski, Jr. et al. | 112/470.03 |
| 5,289,788 | 3/1994 | Fukumoto | 112/470.03 |
| 5,461,999 | 10/1995 | Marcangelo | 112/306 |
| 5,544,599 | 8/1996 | Frazer et al. . | |
| 5,685,250 | 11/1997 | Kaetterhenry et al. . | |
| 5,873,315 | 2/1999 | Codos . | |
| 6,012,403 | 1/2000 | Codos et al. . | |

*Primary Examiner*—Peter Nerbun
*Attorney, Agent, or Firm*—Wood, Herron & Evans, L.L.P.

[57] ABSTRACT

A quilting machine is provided having a first station and a second station, one being a printing station and one being a quilting station. The printing station is located either in line and preferably upstream of the quilting station, with a conveyor extending through each of the stations to convey a web of quilting material through the machine, or is off of the quilting line such that the material with a pre-applied pattern thereon is transferred, preferably in web form, to the line of the second station for the application of a pattern in registration with the first applied pattern. At the second station, for example, registration of a plurality of transversely spaced points is detected to determine longitudinal and transverse registration as well as skewing or rotation of the material, and the opposite transverse sides of the material are differently adjusted to orient and register the material. Where the second station is a multi-needle quilting station, different parts of the quilted pattern are applied in precise registration with the preprinted pattern. A master batch controller assures that the proper combinations of printed and quilted patterns are combined to allow small quantities of different quilted products to be produced automatically along a material web.

32 Claims, 5 Drawing Sheets

PRINTING AND QUILTING METHOD AND APPARATUS USEFUL FOR AUTOMATED MULTI-NEEDLE QUILTING AND PRINTING ONTO WEBS

This is a continuation-in-part of the commonly assigned U.S. patent application Ser. No. 09/250,352, filed Feb. 16, 1999 is now U.S. Pat. No. 6,012,403, which is a continuation-in-part of the commonly assigned U.S. patent application Ser. No. 09/070,948, filed May 1, 1998, now U.S. Pat. No. 5,873,315, both hereby expressly incorporated by reference herein.

FIELD OF THE INVENTION

The present invention relates to the quilting, and particularly to the quilting of patterns on multiple layer materials such as mattress covers, comforters, bedspreads and the like, especially composite patterns in which the overall appearance of the quilted product includes a combination of printed and quilted features. The invention is particularly useful where the quilting is performed on multi-needle quilting machines, where the quilting and printing are applied to roll fed or web material or where differing products are produced in small quantities and in batches.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. In quilting, two different approaches are generally used.

Single needle quilters of the type illustrated and described in U.S. patent application Ser. No. 08/497,727, filed Jun. 30, 1995, U.S. Pat. No. 5,640,916 and entitled Quilting Method and Apparatus, hereby expressly incorporated by reference herein, and those patents cited and otherwise referred to therein are customarily used for the stitching of most comforters, some bedspreads and other products from preformed or pre-cut rectangular panels. Some single needle quilters are used to quilt patterns on fabric that carries a pre-woven or printed pattern, with the quilting adding to or enhancing the appearance of the pattern. Such quilters require that pre-patterned material be manually positioned in the quilting apparatus so that the quilting can be registered with the pre applied pattern or a complicated visual positioning system be used. With such systems, border quilting or coarse pattern quilting can be achieved but high quality outline quilting around the pre applied patterns or the quilting of pattern details of a fraction of an inch in scale are difficult to achieve. Single needle quilters are usually lock stitch machines.

Multiple needle quilters of the type illustrated in U.S. Pat. No. 5,154,130, hereby expressly incorporated by reference herein, are customarily used for the stitching of mattress covers, some bedspreads and other such products which are commonly formed from multi-layered web fed material. These multi-needle quilters include banks of mechanically ganged needles that sew multiple copies of a recurring pattern on the fabric. With such multi-needle machines, the combining of quilting with pre-applied printed or woven patterns in the fabric which would require registration of the quilting with the pre-applied patterns is usually not attempted. Multi-needle quilters are usually chain stitch machines.

Other quilting machines and methods employing some of the characteristics of both single needle panel type quilters and web fed multi-needle quilters are disclosed in U.S. patent application Ser. No. 08/831,060 of Jeff Kaetterhenry, et al. filed Apr. 1, 1997 and entitled Web-fed Chain-stitch Single-needle Mattress Cover Quilter with Needle Deflection Compensation, now U.S. Pat. No. 5,832,849 and U.S. patent application Ser. No. 09/189,656 of Bondanza et al., filed Nov. 10, 1998 and entitled Web-fed Chain-stitch Single-needle Mattress Cover Quilter with Needle Deflection Compensation, both hereby expressly incorporated by reference herein. Such a machine uses one or more separately controllable single needle heads that apply chain stitches to panels or webs.

The production of quilts by off-line processes involving both printing and quilting processes has involved the outlining or other coordinated stitching onto material on which patterns have been preprinted. Stitching is traditionally carried out with manually guided single needle quilting machines. Proposed automated systems using vision systems to follow a preprinted pattern or other schemes to automatically stitch on the preprinted material have been proposed but have not proven successful. Registration of pattern stitching with preprinted patterns has been a problem. While efforts to align printing and stitching longitudinally or transversely have been made, angular orientation of the patterns has been ignored. Correction for misalignment of quilted and printed patterns by repositioning of a quilting or printing head is inadequate if multi-needle quilters are to be used, particularly where angular mis-orientation is present.

Application of registration techniques to roll fed materials, where printing and quilting are best performed on material webs, presents additional problems. When using web materials, registration errors that would result if conventional techniques were applied would produce cumulative errors. This would be particularly true where angular orientation errors result due to skewing of the web as it is fed into the subsequent pattern applying machine after removed from a machine in which the first pattern has been applied.

With off-line processes for applying one pattern and then another in registration with the first, one by printing and one by quilting, production of quilts in small batches is particularly a problem. Each batch can include one or a few quilted products of a common design made up of a printed pattern and a quilted pattern, with the products of different batches, preferably to be consecutively made on the same machinery, being made up of a different printed pattern in combination with a different quilted pattern. As a result, the matching of the second pattern to be applied with the correct pre-applied pattern as the partially completed products are moved from a first machine or production line to a second is critical and a potential source of error as well as production delay.

For example. the outer layer of material used for mattress covers, often referred to as ticking, is supplied in a variety of colors and preprinted or dyed patterns. Generally, mattress manufacturers who are the customers of the quilted mattress cover manufacturers or quilting machinery manufacturers require a wide variety of ticking material patterns to produce a variety of bedding products. Frequently, small quantities of each of the variety of products must be made to supply their customers' requirements, requiring the maintenance of inventories of a large number of different patterns of ticking material, which involves substantial cost. Further, the need to constantly match patterns as well as to change ticking supply rolls when manufacturing such a variety of products in small quantities can be a major factor in reducing the throughput of a mattress making process and delaying production. These and related problems continually exist in the manufacture of bedspreads, comforters and other quilted products where a variety of products in small quantities is desired.

There exists a need in mattress cover manufacturing for a capability of efficiently producing small quantities of quilted fabric such as mattress covers, comforters, bedspreads and the like where different pre-applied patterns on the product are desired to be enhanced by combining the pre-applied and quilted patterns, particularly where combinations of quilted patterns and printed or other pre-applied patterns must vary with each or every few products.

SUMMARY OF THE INVENTION

An objective of the present invention is to provide quilt manufacturers, particularly mattress cover manufacturers, with the ability to produce quilted products having a wide variety of patterns that include both quilting and printed or other images or designs without the need to inventory material in a large number of different pre-applied designs.

A further objective of the invention is to provide for the intricate outline or other coordinated quilting of designs or patterns on multi-layered materials in a highly efficient, economical, high speed and automated manner, particularly by both applying the printed design or pattern and quilting the outline or other coordinated quilted enhancement of the printed design or pattern in sequence on the same manufacturing line.

Another objective of the present invention is to efficiently provide for customizable printed and quilted patterns on mattress covers, bedspreads and the like, which can be varied on an individual piece basis or with among items produced in small quantities.

A further objective of the present invention is to reduce quilting downtime due to the need to make ticking or other material changes, pattern changes or machine adjustments. A more particular objective of the present invention is to provide a quilting method and apparatus with which quilted patterns and printed patterns may be applied in registration and varied on a quilting machine.

A particular objective of the present invention is to aid the production of quilted material by combining both printed patterns and quilted patterns wherein multiple copies of the quilted patterns can be simultaneously applied using a multi-needle quilter. An additional particular objective of the present invention is to facilitate accurate coordinated application of patterns by printing and quilting to web or roll fed material. Another particular objective of the present invention is to assist in the automatic coordination of printed and quilted patterns of products produced successively in small batches of different products. These objectives are most particularly sought in systems in which a first pattern, such as a printed pattern, is applied off-line from the machine on which the second pattern, such as a quilted pattern, is to be applied in registration with the first pattern.

According to principles of the present invention, a quilting method and apparatus are provided for the manufacture of a quilted product by a combination of printed pattern application and quilting. The process provided includes: the selecting of a print pattern to be printed on the material, the selecting of a quilt pattern to be quilted on the material, the application of the printed pattern by moving a printing head relative to the material and, the application of a quilted pattern by moving a quilting head relative to the material, with the pattern that is applied second being applied in registration with the first. Preferably the printed pattern is applied first.

According to certain principles of the present invention, printed designs and coordinated quilted patterns are applied upon multilayered material in the same production line and under the control of a common machine and pattern controller. Multiple layers of the material for the forming a quilt are supported on a frame on which a printing head and a quilting head are also mounted. A mechanism is provided to impart relative movement of the supported material relative to the quilting and printing heads. Such a mechanism can include a material conveyor that moves the material with respect to the frame, and/or head transport mechanisms that move the heads to and from the material when it is fixed relative to the frame. Either the supported material or the heads or both are moved relative to each other under the control of a programmed computer control to apply printed designs and quilted patterns to the material in mutual registration. Preferably, the printed designs are applied first onto the top layer or facing material, then a pattern is quilted in registration with the printed designs. Alternatively, printed designs can be applied after the patterns are quilted.

According to certain preferred embodiments of the present invention, a quilting apparatus is provided with a supply of multiple layers of material to be quilted and printed with a combination printed design and quilt pattern. An outer or top layer is fed, preferably as a continuous web, through a series of stations. At one station, a printed design is applied to the top or facing layer of material. At another station, preferably downstream of the printing station, a quilted pattern is applied to the multiple layered fabric of material including the facing material layer and filler and backing material layers. Whichever pattern or design is applied second, preferably the quilted pattern, it is applied in registration with the pattern or design that has been applied first to the fabric under the control of a programmed controller. A curing station or oven may be further provided downstream or as part of the printing station to cure the dye or ink applied at the printing station.

In certain preferred machines, a printing station is provided on a frame and quilting station is located on the frame, preferably downstream from the printing apparatus. A material conveyer is provided that brings fabric printed at the printing station into the quilting station with the location of the printed pattern known so that one or more quilting heads at the quilting station can be registered with the printed pattern.

According to one preferred embodiment of the invention, the printing station includes one or more ink-jet printing or dye transfer heads moveable under computer control over the outer or facing layer of material. Additional layers of material are combined with the outer layer, preferably downstream of the printing station and after a printed pattern is applied to the outer layer at the printing station. In this embodiment, the quilted pattern is then quilted onto the material in registration with the printed pattern. Registration may be achieved by maintaining information in a controller of the location of the printed pattern on a facing material and of the relative location of the heads with respect to the facing material.

In certain preferred embodiments where the material is moved on a conveyor successively through the printing and quilting stations, information of the location of the design or pattern on the facing material and of the material on the conveyor is maintained by the controller. The material may be fed in separate precut panel sections, as continuous patterns and designs along a web, or in discrete panel sections along a continuous web.

Where the printed design is applied before the quilting, which is preferred, information of the exact location of the design on the facing material is maintained as the material moves from the printing station, as the filler and backing layers of material are brought into contact with the outer layer or facing material, and as the material is fed to the quilting station. For example, outline quilting the pattern in computer controlled registration with the printed pattern can be carried out, or some other quilting pattern can be applied, based on the maintained registration information of the pattern on the web moving through the apparatus.

In one preferred embodiment of the invention, exact registration between the design that is printed onto the material and the pattern that is quilted on the material is maintained by holding a panel section of the multi-layered material onto which the pattern is printed in some securing structure at and between the printing and quilting stations. The panel section can be a separate panel or a portion of a web of material, and may be secured in place on a conveyor. In such an embodiment, the registration may be maintained throughout the entire printing and quilting operation by side securements such as, for example, a pin-tentering material transport that keeps the material fixed relative to the conveyor or securing structure through the printing process and the quilting process. A programmed or process controller controls the relative movement of the fabric and printing and quilting heads, and coordinates the movement in synchronization with printing head control and quilting head control so that the printed and quilted patterns are applied in precise registration.

In other embodiments of the invention, the pattern is applied off-line, preferably the printing process. The printed pattern may include a machine identifiable mark or other reference, such as may be achieved by the printing of selvage edge registration marks on the material that are uniquely positioned relative to the printed pattern. The printed material is then transferred to a quilting line at which a quilted pattern is applied in registration with the printed pattern. Preferably, machine readable registration information is produced on the material at more than one transversely spaced points on the material, such as on opposite selvages or side edges of the material. Separate determinations are made from the plural marks as to the relative alignment at two places on the material, such as at both of the opposite side edges. Thus, two such marks can be located when the second pattern is registered to the first, and determination can be made of the skewing or rotation of the material carrying the first or pre-applied pattern.

Adjustment to eliminate skewing or rotation of the fabric, and thereby to achieve registration of the second pattern with the first at transversely spaced locations on the material, is provided by side-to-side material position adjustment. Preferably, adjustment is provided by a split feed roll, with separately rotatable right and left components that are separately controlled in response to separate determinations of the registration of the right and left sides of the material.

Preferably, the patterns are applied to webs of material on which different products are to be quilted along the length of the material prior to the panels being separated from the web. Multi-needle quilting machines are also preferably used. Where the printing is applied to the web off-line, side-to-side registration that overcomes the effects of skewing or mis-orientation of the web achieves equally good registration of the different pattern copies being stitched simultaneously by the multiple needles and overcomes cumulative registration errors as the web is fed.

In certain embodiments of the invention, vision systems may be employed to determine or verify the location of the printed pattern and to enhance or provide registration of the quilting with the printing. Such a vision system may be employed in addition or in the alternative to the computer control of the material transport.

Printed patterns or designs and the quilted patterns may be programmed or stored in memory and, in a programmed or operator selected manner, printed designs and quilted patterns may be combined in different combinations to produce a wide variety of composite printed and quilted patterns.

In alternative embodiments, the material may be held stationary, rather than moved relative to a fixed frame, and the printing and quilting heads of the respective printing and quilting stations may move relative to the frame and the material fixed on the frame, under the coordination of a controller, to bring a printing head or a quilting head into position over the portion of the material on which a pattern is to be applied. In most applications, quilting a pattern after applying a printed design is preferred. However, aspects of the invention can be utilized to print designs onto material after quilting the material.

Preferably, a batch control automated system keeps track of the products moving through the process. Where one pattern applying process is off-line, such as where printing is carried out on a line separate from the quilting line on which the stitched pattern is applied, the control matches the quilted pattern and the printed patterns required by each product or batch of products. This can be carried out by maintaining information in a control system memory that will allow for the following of the product through the system or can be assisted by automatically identifying the product on the second line, such as by reading a code, such as a bar code, applied to the product previously and correlated with the pattern that was printed onto the panel or product. Batch control systems are described in U.S. Pat. No. 5,544,599 and in U.S. patent applications Ser. No. 09/301,653, filed Apr. 28, 1999, and Ser. No. 09/359,539, filed Jul. 22, 1999, all hereby expressly incorporated by reference herein.

In the manufacture of mattress covers, printed and quilted top and bottom panels can be produced along with strips of border fabric that are to cover the border, including the sides and the head and foot, of a mattress. Such border panels can be produced with coordinated printed designs and patterns that match or correspond to the top and bottom panels. This can be achieved according to one embodiment of the invention by printing and quilting a strip of fabric along a width of the same web material of which the top and bottom panels are being made. The border panel printing and quilting are carried out under the control of a programmed controller, preferably the same controller that coordinates the application of the printed designs and quilted patterns on the top and bottom panels. The border panels so made are then cut or slit from the web that carries the top and bottom panels.

As an alternative to forming border panels out of the same web as the top and bottom panels, a separate but smaller machine having separate quilting and printing stations may be provided adjacent and linked to the main machine on which the mattress top and bottom panels can be applied.

The separate machine is supplied with material for forming the border panels that is narrower than, but matches, the material supplied to the main machine for forming the top and bottom panels. Both machines are controlled by the same controller or a controllers that are in communication with each other to coordinate the making of the mattress cover units or batches of units with matching or coordinated top, bottom and border panels. Border panels are of different widths, corresponding to mattresses of different thicknesses, and are of a length equal to the periphery of the mattress rather than the length of the mattress. In addition, border panels have thinner fill layers, being in the range of from ¼ to ½ inches thick, where the top and bottom panels are usually from ½ inch to 3 or 4 inches thick. For these reasons, the embodiment using the separate border panel machine is preferred in that it provides for more efficient use of different lengths of material and provides less process complexity.

The present invention provides the ability to change printed patterns in the course of a quilting run, and to change both printed and quilted patterns to produce quilted products in a wide variety of composite patterns. With the invention, the number of base cloth supplies required to provide pattern variety is greatly reduced, saving substantial costs to the quilted product manufacturer. With the invention, the appearance of the outer layer can be embellished to provide variety and detail, and outline quilting can be carried out in high quality and in close proximity to the printed design. Further, with the invention, these advantages are available with both single needle and multiple needle quilters.

These and other objects of the present invention will be more readily apparent from the following detailed description of the drawings.

DETAILED DESCRIPTION OF THE PREFERRED EMBODIMENT

Figure 1:
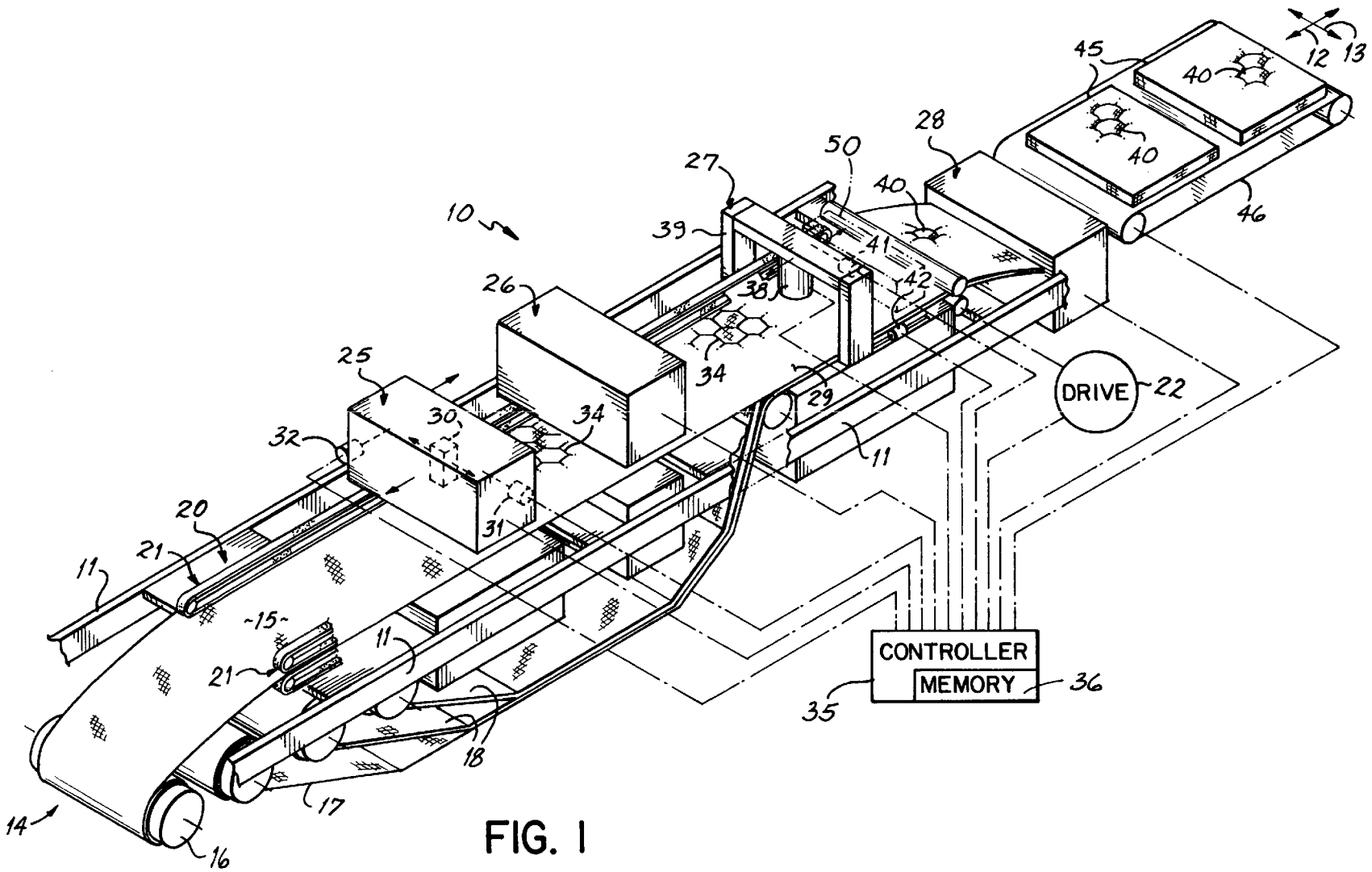
FIG. 1 is a diagrammatic perspective view of a one embodiment of a web-fed mattress cover quilting machine embodying principles of the present invention.

FIG. 1 illustrates a quilting machine 10 having a stationary frame 11 with a longitudinal extent represented by arrow 12 and a transverse extent represented by arrow 13. The machine 10 has a front end 14 into which is advanced a web 15 of ticking or facing material from a supply roll 16 rotatably mounted to the frame 11. A roll of backing material 17 and one or more rolls of filler material 18 are also supplied in web form on rolls also rotatably mounted to the frame 11. The webs are directed around a plurality of rollers (not shown) onto a conveyor or conveyor system 20, each at various points along the conveyor 20. The conveyor system 20 preferably includes a pair of opposed pin tentering belt sets 21 which extend through the machine 10 and onto which the outer layer 15 is fed at the front end 14 of the machine 10. The belt sets 21 retain the web 15 in a precisely known longitudinal position thereon as the belt sets 21 carry the web 15 through the longitudinal extent of the machine 10, preferably with an accuracy of 0 to ¼ inch. The longitudinal movement of the belt 20 is controlled by a conveyor drive 22. The conveyor 20 may take the alternative forms including but not limited to opposed cog belt side securements, longitudinally moveable positive side clamps that engage and tension the material of the web 15 or other securing structure for holding the facing material web 15 fixed relative to the conveyor 20.

Along the conveyor 20 are provided three stations, including a printing station 25, a drying station 26, a quilting station 27 and a panel cutting station 28. The backing material 17 and filler material 18 are brought into contact with the top layer 15 between the drying station 26 and the quilting station 27 to form a multi-layered material 29 for quilting at the quilting station 27. Preferably, the layers 17 and 18 are not engaged by the belt sets 21 of the conveyor 20 but rather are brought into contact with the bottom of the web 15 upstream of the quilting station 27 to extend beneath the web 15 through the quilting station 27 and between a pair of pinch rollers 44 at the downstream end of the quilting station 27. The rollers 44 operate in synchronism with the belt sets 21 and pull the webs 17 and 18 through the machine 10 with the web 15.

The printing station 25 includes one or more printing heads 30 that are transversely moveable across the frame 11 and may also be longitudinally moveable on the frame 11 under the power of a transverse drive 31 and an optional longitudinal drive 32. Alternatively, the head 30 may extend across the width of the web 15 and be configured to print an entire transverse line of points simultaneously onto the web 15. The head 30 is provided with controls that allow for the selective operation of the head 30 to selectively print two dimensional designs 34 of one or more colors onto the top layer web 15. The drive 22 for the conveyor 20, the drives 31 and 32 for the print heads 30 and the operation of the head 30 are program controlled to print patterns at known locations on the web 15 by a controller 35, which includes a memory 36 for storing programmed patterns, machine control programs and real time data regarding the nature and longitudinal and transverse location of printed designs on the web 15 and the relative longitudinal position of the web 15 in the machine 10.

The drying station 26 is fixed to the frame 11. The drying station may be of whatever configuration is suitable to effectively dry the dye being applied at the printing station 25. It may operate continuously or be selectively controlled in accordance with the pattern, as is appropriate. While the print head 30 is preferably a digital dot printer in which the coordinates of each dot of the image printed is capable of being precisely located on the web 15 and relative to the conveyor 20, screen printed, roll printed or other types of printed images may be used while still realizing some of the advantages of the invention.

The quilting station 27 is, in this illustrated embodiment, a single needle quilting station such as is described in U.S. patent application Ser. No. 08/831,060 to Jeff Kaetterhenry, et al. and entitled Web-fed Chain-stitch Single-needle Mattress Cover Quilter with Needle Deflection Compensation, which is expressly incorporated by reference herein, now U.S. Pat. No. 5,832,849. Other suitable single needle type quilting machines with which the present invention may be used are disclosed in U.S. patent applications Ser. Nos. 08/497,727 and 08/687,225 and both entitled Quilting Method and Apparatus, expressly incorporated by reference herein, now U.S. Pat. Nos. 5,640,916 and 5,685,250, respectively. The quilting station 27 may also include a multi-needle quilting structure such as that disclosed in U.S. Pat. No. 5,154,130, also expressly incorporated by reference herein. In FIG. 1, a single needle quilting head 38 is illustrated which is transversely moveable on a carriage 39 which is longitudinally moveable on the frame 11 so that the head 38 can stitch 360° patterns on the multi-layered material 29.

The controller 35 controls the relative position of head 38 relative to the multi-layered material 29, which is maintained at a precisely known position by the operation of the drive 22 and conveyor 20 by the controller 35 and through the storage of positioning information in the memory 36 of the controller 35. In the quilting station 27, the quilting head 38 quilts a stitched pattern in registration with the printed pattern 34 to produce a combined or composite printed and quilted pattern 40 on the multi-layered web 29. This may be achieved, as in the illustrated embodiment by holding the assembled web 29 stationary in the quilting station 27 while the head 38 moves both transversely, under the power of a transverse linear servo drive 41, and longitudinally on the frame 11, under the power of a longitudinal servo drive 42, to stitch the 360° pattern by driving the servos 41 and 42 in relation to the known position of the pattern 34 by the controller 35 based on information in its memory 36. Alternatively, the needles of a single or multi-needle quilting head may be moved relative to the web 29 by moving the quilting head 38 only transversely relative to the frame 11 while moving the web 29 longitudinally relative to the quilting station 27, under the power of conveyor drive 22, which can be made to reversibly operate the conveyor 20 under the control of the controller 35.

In certain applications, the order of the printing and quilting stations 25 and 27 can be reversed, with the printing station 25 located downstream of the quilting station 27, for example the station 50 as illustrated by phantom lines in FIG. 1. When at station 50, the printing is registered with the quilting previously applied at the quilting station 27. In such an arrangement, the function of the curing station 26 would also be relocated to a point downstream of both the quilting station 27 and printing station 50 or be included in the printing station 50, as illustrated.

The cutoff station 28 is located downstream of the downstream end of the conveyor 20. The cutoff station 28 is also controlled by the controller 35 in synchronism with the quilting station 27 and the conveyor 20, and it may be controlled in a manner that will compensate for shrinkage of the multi-layered material web 29 during quilting at the quilting station 27, or in such other manner as described and illustrated in U.S. Pat. No. 5,544,599 entitled Program Controlled Quilter and Panel Cutter System with Automatic Shrinkage Compensation, hereby expressly incorporated by reference herein. Information regarding the shrinkage of the fabric during quilting, which is due to the gathering of material that results when thick filled multi-layer material is quilted, can be taken into account by the controller 35 when quilting in registration with the printed pattern 34. The panel cutter 28 separates individual printed and quilted panels 45 from the web 38, each bearing a composite printed and quilted pattern 40. The cut panels 45 are removed from the output end of the machine by an outfeed conveyor 46, which also operates under the control of the controller 35.

Figure 2:
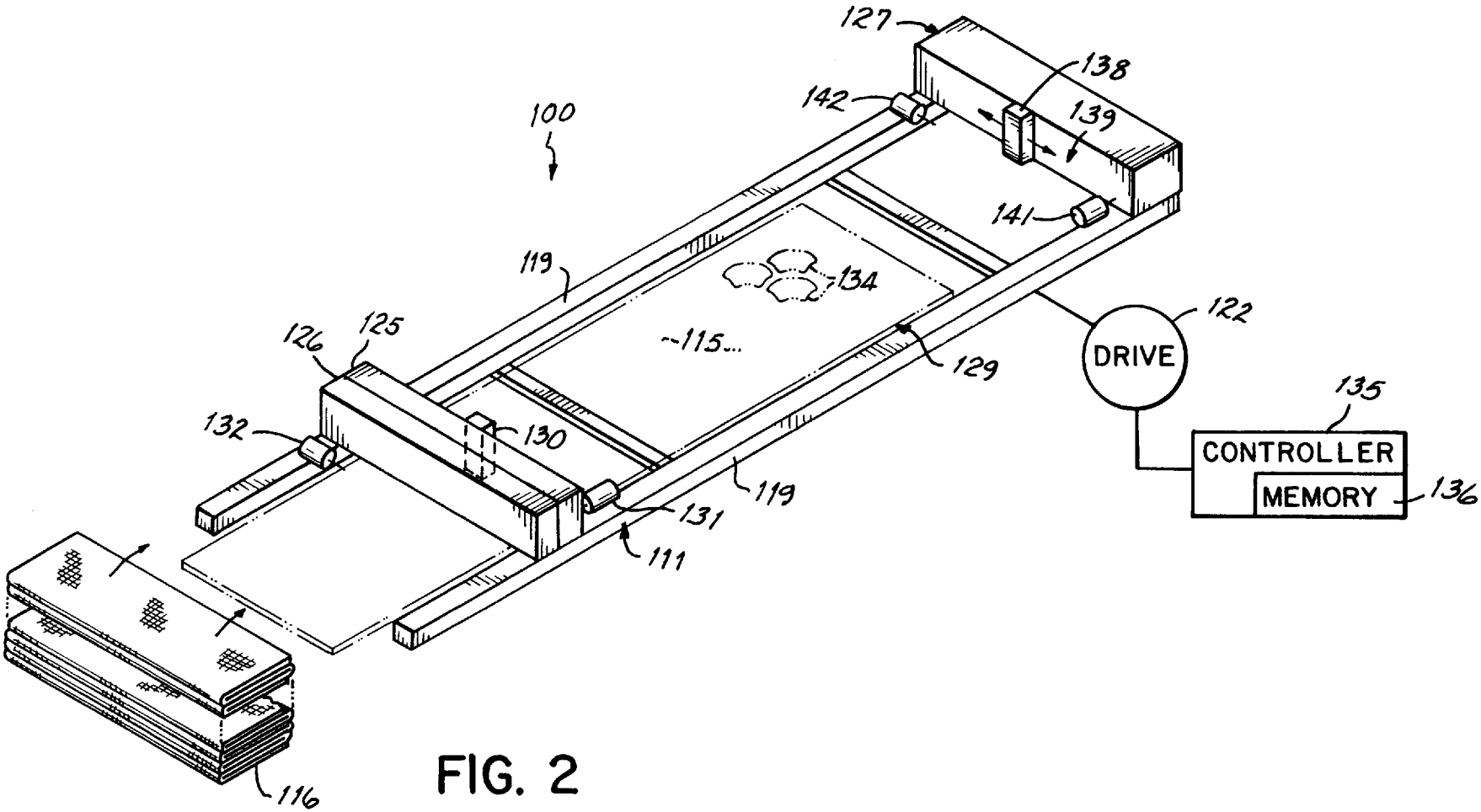
FIG. 2 is a diagrammatic perspective view of a discrete panel quilting machine which is an alternative embodiment to the machine of FIG. 1 that is more suitable for the production of comforters.

FIG. 2 illustrates an embodiment 100 of the invention that which employs a single needle frame supported discrete panel quilting machine such as those described in U.S. Pat. No. 5,832,849. Other machines of that type are disclosed in U.S. Pat. Nos. 5,640,916 and 5,685,250. These single needle quilting machines apply patterns to precut panels and are useful for manufacturing comforters, for example. The machine 100 has an operator accessible stack 116 of pre-formed panels from which the panel 129 is taken and loaded into the machine 100. A conveyor or conveyor system 120 moves a set of panel supporting edge clamps or other edge securements 121 to bring the panel 129 into a fixed position for application of a combination pattern by printing onto the outer top layer 115 of the multilayered fabric 129 and by quilting the multilayered fabric 129.

In the embodiment 100, a printing station 125, which includes a combined drying station 126 and a quilting station 127 are provided on moveable tracks 119 that are fixed relative to the machine frame 111. The printing station 125 includes one or more printing heads 130 that are transversely moveable across on the moveable station 125 across the frame 111 under the power of a transverse drive 131 and is longitudinally moveable under the power of a longitudinal drive 132. The head 130 is provided with controls that allow for the selective operation of the head 130 to selectively print two dimensional designs 134 of one or more colors onto the top layer 115. The drive 122 for the conveyor 120, the drives 131 and 132 for the print heads 130 and the operation of the head 130 are program controlled to print designs or patterns at known locations on the facing material 115 by a controller 135, which includes a memory 136 for storing programmed patterns, machine control programs and real time data regarding the nature and longitudinal and transverse location of printed designs on the material 115 and the relative position of the panel 129 in the machine 100. The drying station 126 may be moveable with the printing station 125, independently moveable on the frame 111, or fixed to the frame 111 in a position at which it can operate to cure the print medium applied by the printing head 130 without interfering with the printing station 125 or quilting station 127.

The quilting station 127 is, in this embodiment 100, is preferably a single needle quilting station such as is described in U.S. Pat. No. 5,832,849. The quilting station 127 has a single needle quilting head 138 which is transversely moveable on a carriage 139 which is longitudinally moveable on the frame 111 so that the head 138 can stitch 360° patterns on the multi-layered material 129. This is achieved, in the embodiment 100, by holding the panel 129 stationary while the quilting head 138 moves both transversely, under the power of a transverse linear servo drive 141, and the station 127 moves longitudinally on the frame 111, under the power of a longitudinal servo drive 142, to stitch the 360° pattern.

The controller 135 coordinates the motion and operation of the printing station 125 and the quilting station 127 to that one applies a pattern or design panel 129 and then the other applies a coordinated pattern or design in registration. The machine 100 can apply either the printed design first and then register the quilted pattern to it, which is the preferred order, or can apply the quilted pattern first and then register the printed design to the quilted pattern. The controller 135 controls the operation of these stations.

Figure 3:
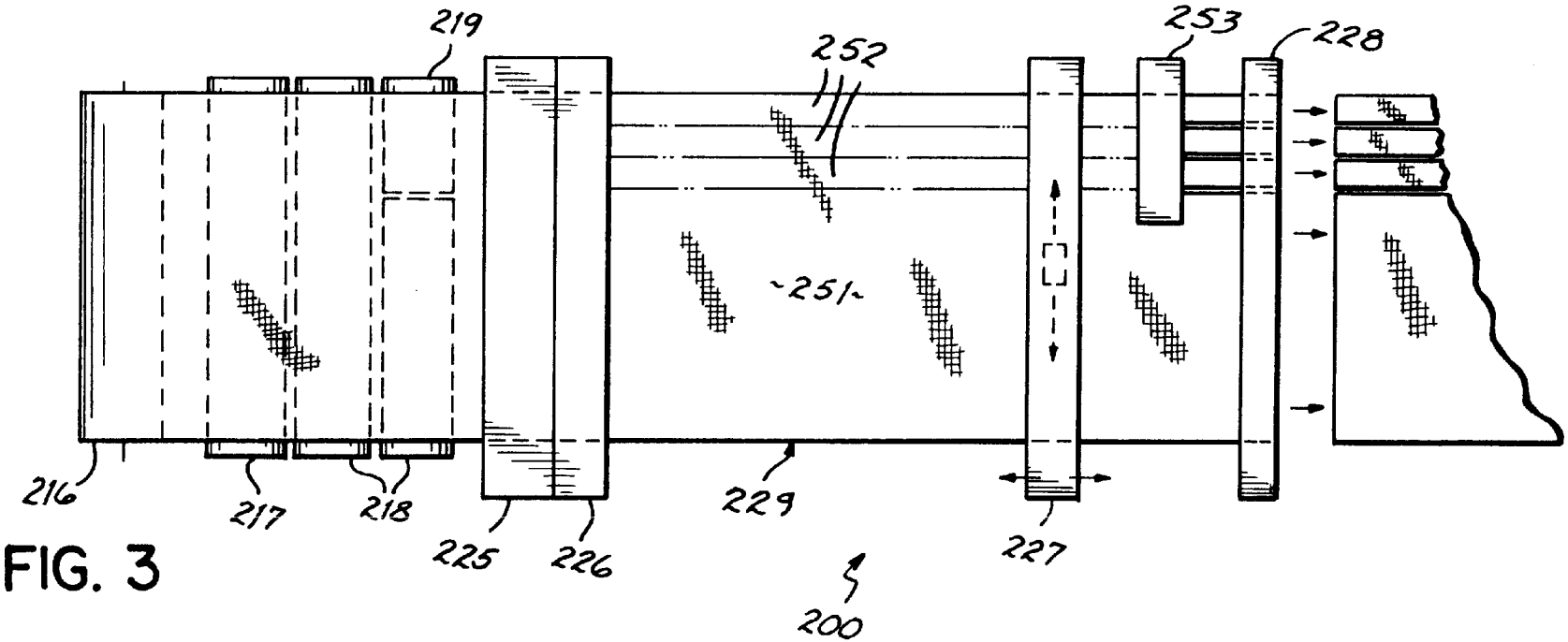
FIG. 3 is a top view of an alternative embodiment of the web-fed mattress cover quilting machine of FIG. 1 that includes structure for making coordinated top and bottom panels and border panels for mattress covers.

FIG. 3 illustrates an embodiment 200 that is similar to the machine 10 of FIG. 1 but further includes the capability to apply combination patterns to different areas of a wide multilayered fabric 229 to produce top or bottom panels 251 with matching border panels 252 of a mattress cover. The machine is provided with supplies 218 and 219 of filler material of different thicknesses at different positions across the width of the facing material 215. The machine 200 is also provided with a slitting station 253 adjacent cutoff station 228, to slit the border panels 252 from the top and bottom panels 251.

Figure 4:
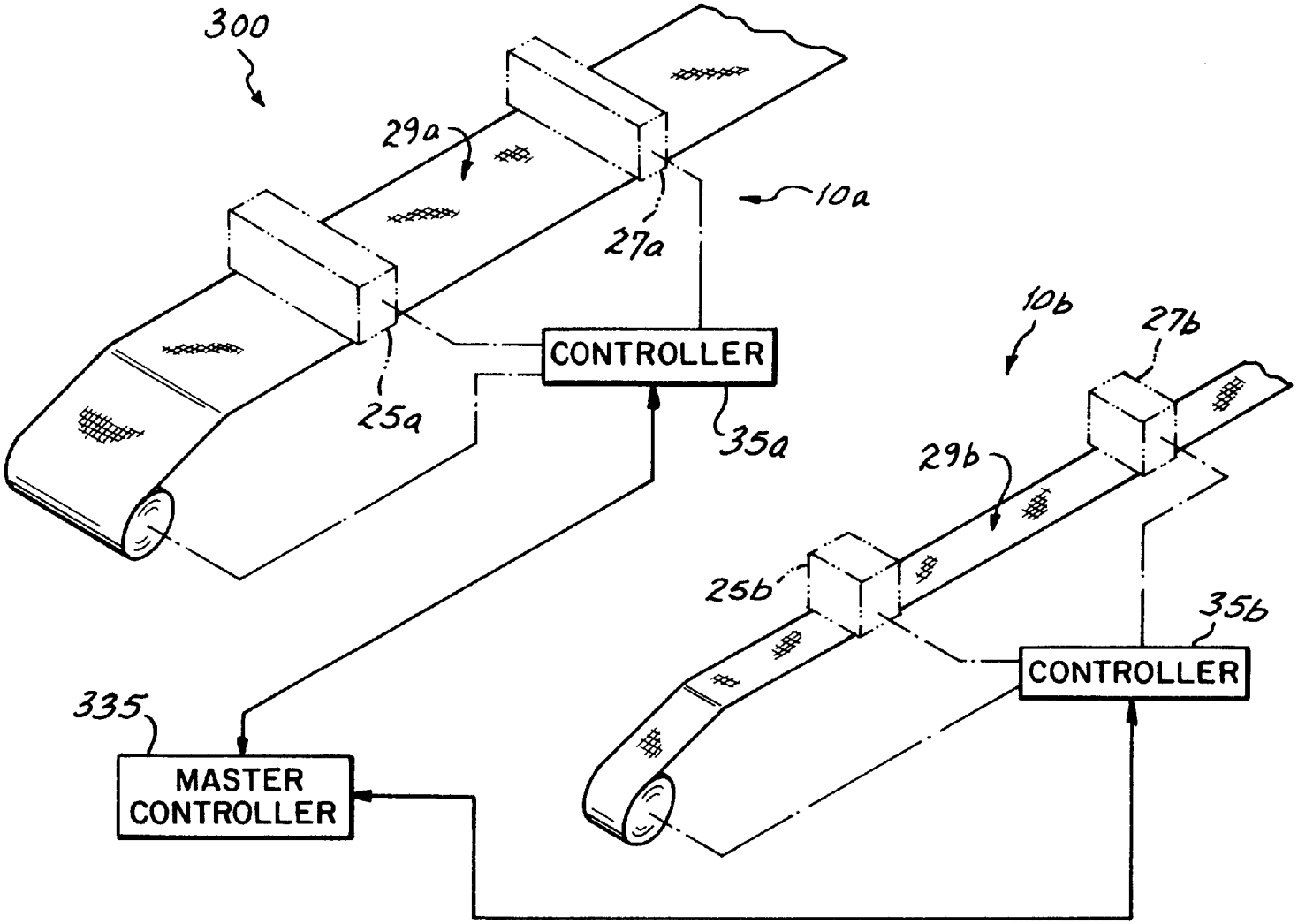
FIG. 4 is a diagrammatic perspective view of an alternative embodiment to the machine of FIG. 3.

FIG. 4 illustrates an alternative and preferred embodiment 300 for producing matching top and bottom panels and border panels for mattress covers. The embodiment 300 includes a machine 10*a* of the type similar to the machine 10 described in connection with FIG. 1 above in combination with a similar narrower version of a machine 10*a*. The machine 10*a* produces the top and bottom panels from multilayered fabric 29*a* that is dimensioned according to the specification for such panels, including a relatively thicker filler layer 118*a* of mattress size width and length. The machine 10*b* produces the matching or coordinated border panels from multilayered 29*b* that is dimensioned according to the specification for border panels, including a relatively thin filler layer 118*b* and narrower width that corresponds to the thickness of a mattress but greater length that corresponds to the perimeter of the border of the mattress. The matching of the combination patterns applied to the fabric 29*a*,29*b* is controlled either by a single controller, by a master controller 335 (as illustrated) which controls separate similar machine controllers 35*a*,35*b* of respective machines 10*a*, 10*b*, with separate controllers of the machines 10*a*, 10*b* linked together such that they work in unison or such that the controller of one machine 10*a*,10*b* controls the other. The controller 35*a* controls the operation of the machine 10*a* to produce combination printed designs and quilted patterns on the top and bottom panels of a mattress with printing head 25*a* and quilting head 27*a*, respectively, as with the machine 10 described above. Controller 35*a* controls the operation of the machine 10*b* to produce matching combination printed designs and quilted patterns on border panels for the same mattress with printing head 25*b* and quilting head 27*b*, respectively. Master controller 335 coordinates the operation of the two controllers 35*a* and 35*b*.

Figure 5:
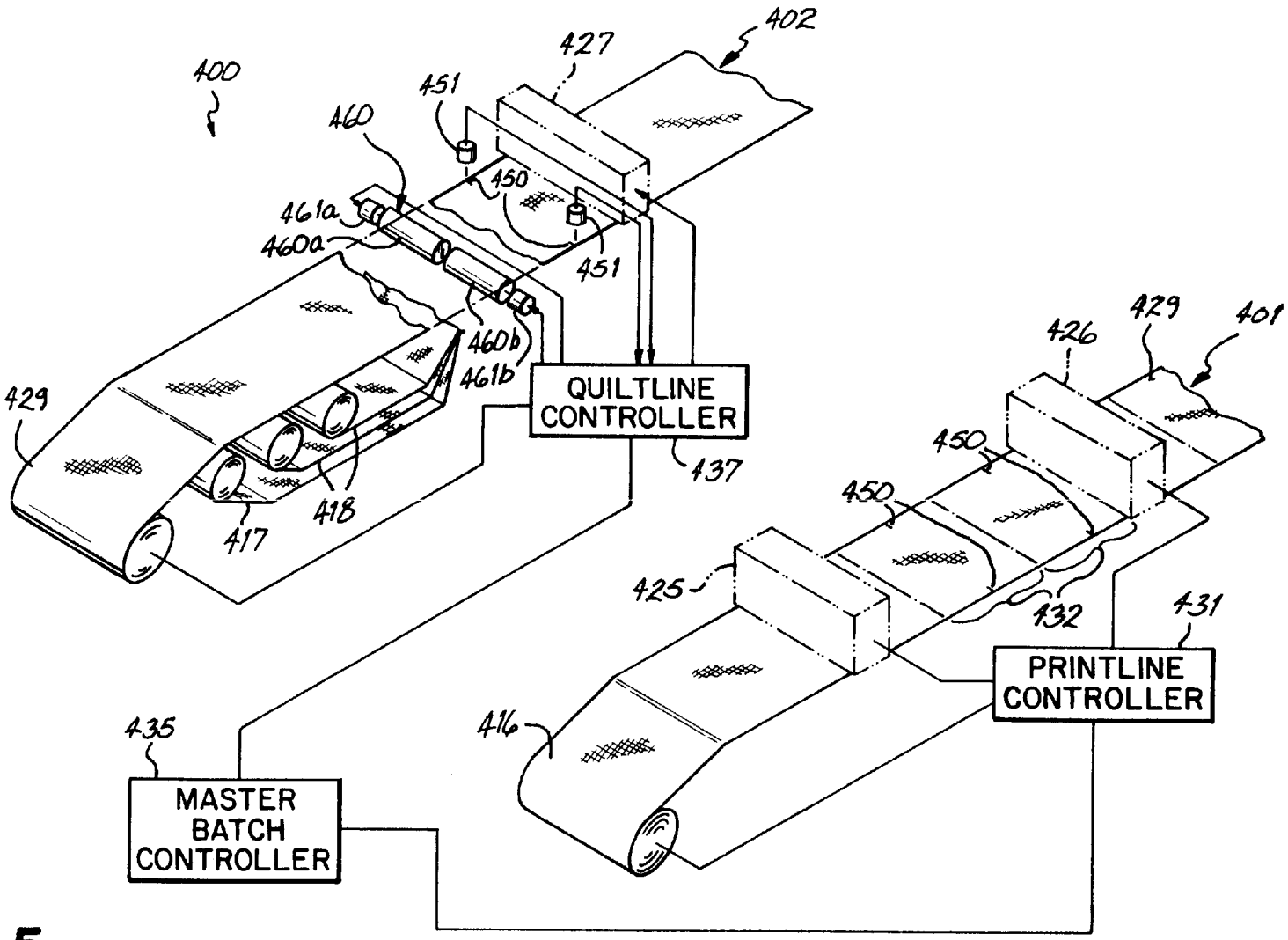
FIG. 5 is a diagrammatic perspective view of an off-line alternative embodiment to the machine of FIG. 1.

In the embodiment of FIG. 5, a quilt printing and quilting system 400 is provided, which includes separate print and quilting lines such as print line 401 and quilt line 402. Quilt line 402 is preferably a multi-needle quilting machine such as that described in U.S. Patent No. 5,154,130. The print line 401 includes a printing station 425, preferably of the jet printing type, and a curing station 426, usually an oven but which may be a UV light curing station or such other station as will cure the type of ink being used. Mattress ticking or some other facing sheet of material 416 is provided, preferably in web form, and fed successively through the printing station 425 and curing station 426. The printing station 425 applies patterns to the web of material 416 in accordance with pattern programs controlled by a print line controller 431 on one or more successive panel lengths 432 along the web. The patterns may be changed from panel to panel in accordance with a batch controller 435 which supplies product information to the printing controller 431. The print line 401 produces a plurality of printed panels preferably on a web 429 of the facing material from the supply 416.

In the preferred embodiment, the printing performed at the printing line 401 prints, in addition to a series of panel patterns, a series of registration marks 450. The registration marks 450 are preferably printed on the opposite selvages or side edges of web and are configured, for example in a Z-shape, to provide information so that, when detected, both longitudinal and transverse positioning of the respective edge of the web 429 can be determined. The opposite marks 450 are preferably aligned with each other and include one opposed pair of marks for each panel, although more than one pair per panel may be used for added accuracy.

After printing, the web of preprinted material 429 is preferably re-rolled and transported to the quilting machine 402 into which it is loaded and on which it is combined with a backing liner web 417 and one or more filler material webs 418. The combined webs 429, 417 and 418 are engaged by front feed rolls 460 from which they are advanced through a quilting station 427 of the multi-needle type at which a plurality of pattern components are quilted onto the previously printed web 429 in registration with the patterns printed thereon. In lieu of feed rolls 460, other types of separately controllable feed elements that can feed or otherwise move the material in a way that will rotate or redirect the material to adjust the skew of the material can be used.

The quilting machine 402 has, immediately upstream of the quilting station 427, a pair of sensors 451, one over the right edge of the web 429 and one over the left edge of the web 429. The sensors 451 may be photo electric detectors that are capable of sensing the respective positions of the marks 450 so that a controller 437 of the quilting machine 402 can calculate the positions of the opposite edges of the web 429. The controller 437 is programmed to determine the longitudinal and transverse positions of the marks 450 and to derive therefrom the location of the printed patterns so that quilted patterns can be registered with the printed patterns. The program of the controller 437 also calculates any rotation of the panel or skewing of the web 429 relative to the coordinates of the machine 402.

The machine is provided with a split feed roll 460 upstream of the quilting station 427. The split feed roll 460 includes a left half 460*a* and a right half 460*b*, each of which is separately driven by a servo motor 461*a*, 461*b*. The controller 437 differently drives the servo motors 461*a*, 461*b* in response to skewing of the web 429 that is calculated as a result of the analysis by the controller 437 of the outputs of the sensors 451 so as to adjust the transverse position of the web 429 to eliminate the skew. As a result, multiple needles of the quilting station can maintain equal alignments with their respectively corresponding printed patterns. The skew correction in combination with the longitudinal and transverse adjustment of the web 429 results in high accuracy registration of the quilting needles with the printed patterns.

The above description is representative of certain preferred embodiments of the invention. Those skilled in the art will appreciate that various changes and additions may be made to the embodiments described above without departing from the principles of the present invention. Therefore, the following is claimed:

What is claimed is:

1. A method of applying a pattern to a quilt of multiple layered material, in two sequential processes, at least one of which includes the stitching of a part of the pattern onto the material, the method comprising the steps of:

applying a first part of the pattern to at least one layer of the material at a first pattern applying station on a first production line;

transferring the material with the first part of the pattern thereon to a second production line having a second pattern applying station thereon configured to apply a second part of the pattern to material supported thereat;

sensing the angular orientation of the material at the second pattern applying station;

in response to the sensing thereof, adjusting the angular orientation of the material relative to the second pattern applying station; and applying the second part of the pattern to the material in registration with the first part of the pattern in accordance with the adjustment of the angular orientation of the material.

2. The method of claim 1 wherein:

the first pattern applying station is a printing station and the second pattern applying station is a quilting station;

the first sequential process includes the printing of the first part of the pattern on a layer of the material at the printing station;

the transferring step includes transferring the material with the first part of the pattern printed thereon to a quilting machine having the quilting station thereon;

the second sequential process includes the quilting of the second part of the pattern on the multiple layered material at the quilting station in registration with the printed part of the pattern.

3. The method of claim 2, wherein:

the quilting station is a multiple needle quilting station having a plurality of needles operable to simultaneously stitch a plurality of transversely spaced components of the quilted part of the pattern; and the adjusting of the angular orientation of the material at the quilting station differently adjusts different ones of the needles bring each needle and the spaced components of the quilted part of the pattern into registration with the corresponding printed components of the printed part of the pattern.

4. The method of claim 3 wherein:

the applying of the first part of the pattern is to at least one layer of a continuous web of the material at the first pattern applying station;

the web of material with the first part of the pattern thereon is transferred to the second production line;

the angular orientation of the web of material is sensed at the second pattern applying station and adjusted relative thereto; and the second part of the pattern is applied to the web of material.

5. The method of claim 4 wherein:

the second production line includes separately controllable transversely spaced feed elements, responsive to the sensing of the angular orientation of the material, adjacent the second pattern applying station.

6. The method of claim 5 wherein:

the separately controllable transversely spaced feed elements include a pair of feed rolls upstream of the second pattern applying station, including one feed roll on each side of the second production line, each roll being separately driven by signals from a controller that is responsive to the sensing of the angular orientation of the material.

7. The method of claim 5 wherein:

the printing station is operable to print separate registration marks on opposite side edges of the material; and the sensing of the angular orientation of the material is achieved by separately sensing the printed registration marks.

8. The method of claim 5 wherein:

the printing station is operable to print a product identification mark associated with a pattern part printed at the printing station; and the method further comprises the steps of:

reading the product identification mark from the material at the second production line and selecting a corresponding pattern part to be applied at the quilting station in response to the reading of the mark.

9. The method of claim 4 wherein:

the printing station is operable to print separate registration marks on opposite side edges of the material; and the sensing of the angular orientation of the material is achieved by separately sensing the printed registration marks.

10. The method of claim 4 wherein:

the printing station is operable to print a product identification mark associated with a pattern part printed at the printing station; and the method further comprises the steps of:

reading the product identification mark from the material at the second production line and selecting a corresponding pattern part to be applied at the quilting station in response to the reading of the mark.

11. The method of claim 2, wherein:

the applying of the first part of the pattern is to at least one layer of a continuous web of the material at the first pattern applying station;

the web of material with the first part of the pattern thereon is transferred to the second production line;

the angular orientation of the web of material is sensed at the second pattern applying station and adjusted relative thereto;

the second part of the pattern is applied to the web of material.

12. The method of claim 11 wherein:

the second production line includes separately controllable transversely spaced feed elements, responsive to the sensing of the angular orientation of the material, adjacent the second pattern applying station.

13. The method of claim 12 wherein:

the separately controllable transversely spaced feed elements include a pair of feed rolls upstream of the second pattern applying station, including one feed roll on each side of the second production line, each roll being separately driven by signals from a controller that is responsive to the sensing of the angular orientation of the material.

14. The method of claim 12 wherein:

the printing station is operable to print separate registration marks on opposite side edges of the material; and the sensing of the angular orientation of the material is achieved by separately sensing the printed registration marks.

15. The method of claim 12 wherein:

the printing station is operable to print a product identification mark associated with a pattern part printed at the printing station; and the method further comprises the steps of:

reading the product identification mark from the material at the second production line and selecting a corresponding pattern part to be applied at the quilting station in response to the reading of the mark.

16. The method of claim 1 wherein:

the sensing of the angular orientation of the material is achieved by separately sensing the printed registration marks.

17. The method of claim 1 wherein:

reading the product identification mark from the material at the second production line and selecting a corresponding pattern part to be applied at the second station in response to the reading of the mark.

18. The method of claim 1 wherein:

the second pattern applying station is a multiple head station operable to simultaneously apply a plurality of transversely spaced components of the second part of the pattern; and the adjusting of the angular orientation of the material at the second pattern applying station differently adjusts different ones of the heads to bring each head and the spaced components of the second part of the pattern into registration with corresponding components of the first part of the pattern.

19. The method of claim 18 wherein:

the applying of the first part of the pattern is to at least one layer of a continuous web of the material at the first pattern applying station;

the web of material with the first part of the pattern thereon is transferred to the second production line;

the angular orientation of the web of material is sensed at the second pattern applying station and adjusted relative thereto; and the second part of the pattern is applied to the web of material.

20. The method of claim 19 wherein:

the second production line includes separately controllable transversely spaced feed elements, responsive to the sensing of the angular orientation of the material, adjacent the second pattern applying station.

21. The method of claim 20 wherein:

the separately controllable transversely spaced feed elements include a pair of feed rolls upstream of the second pattern applying station, including one feed roll on each side of the second production line, each roll being separately driven by signals from a controller that is responsive to the sensing of the angular orientation of the material.

22. The method of claim 20 wherein:

the sensing of the angular orientation of the material is achieved by separately sensing the separate registration marks on opposite side edges of the material at the second production line.

23. The method of claim 19 further comprises the steps of:

reading a product identification mark from the material at the second production line and selecting a corresponding pattern part to be applied at the second station in response to the reading of the mark.

24. A quilting apparatus for applying a pattern to a quilt of multiple layered material, in two sequential processes, at least one of which includes the stitching of a pattern onto the material, comprising:

a printing station operable to print a pattern on a layer of material;

a quilting station having a plurality of needles operable to simultaneously stitch a plurality of transversely spaced components of a quilted pattern on the material;

sensors operable to sense the angular orientation of the material at the quilting station; and feed elements operable in response to the sensors to adjust the angular orientation of the material relative to the quilting station to differently adjust the relationships between different ones of the needles and the material to bring each needle and the spaced components of the quilted pattern into registration with corresponding printed components of the printed pattern.

25. The apparatus of claim 24 wherein:

the feed elements are separately controllable transversely spaced feed elements, responsive to the sensing of the angular orientation of the material, adjacent the quilting station.

26. The apparatus of claim 24 wherein:

the separately controllable transversely spaced feed elements include a pair of feed rolls upstream of the quilting applying station, including one feed roll on each side of the material, each roll being separately driven by signals responsive to the sensing of the angular orientation of the material.

27. The apparatus of claim 24 wherein:

a first production line having the printing station thereon;

a second production line having the quilting station thereon; and the sensors being at the second production line and operable to sense the angular orientation of the material moved thereto that was printed on the first production line.

28. A quilting apparatus for applying a pattern to a quilt of multiple layered material, in two sequential processes, at least one of which includes the stitching of a pattern onto the material, comprising:

a printing station having a conveyor for supporting a continuous web of material and operable to print a pattern at each of a plurality of locations along the web of material;

a quilting station operable to stitch a quilted pattern on the web of material;

sensors operable to sense the angular orientation of the web of material at the quilting station; and feed elements operable in response to the sensors to adjust the angular orientation of the web of material relative to the quilting station to bring the quilted pattern into angular registration with the printed pattern.

29. The apparatus of claim 28 wherein:

the feed elements are separately controllable transversely spaced feed elements, responsive to the sensing of the angular orientation of the material, adjacent the quilting station.

30. The apparatus of claim 29 wherein:

the separately controllable transversely spaced feed elements include a pair of feed rolls upstream of the quilting applying station, including one feed roll on each side of the material, each roll being separately driven by signals responsive to the sensing of the angular orientation of the material.

31. The apparatus of claim 28 wherein:

a first production line having the printing station thereon;

a second production line having the quilting station thereon; and the sensors being at the second production line and operable to sense the angular orientation of the material moved thereto that was printed on the first production line.

32. The apparatus of claim 28 wherein:

the quilting station has a plurality of needles operable to simultaneously stitch a plurality of transversely spaced components of a quilted pattern on the web of material; and the feed elements are operable to differently adjust the relationship between different ones of the needles and different transversely spaced components to bring each needle and the transversely spaced components of the quilted pattern into registration with corresponding printed components of the printed pattern.

* * * * *

UNITED STATES PATENT AND TRADEMARK OFFICE

CERTIFICATE OF CORRECTION

PATENT NO. : 6,158,366
DATED : December 12, 2000
INVENTOR(S) : Richard N. Codos

It is certified that error appears in the above-identified patent and that said Letters Patent is hereby corrected as shown below:

Column 2,
Line 45, after "machine after", insert -- being --.

Column 3,
Line 40, after "basis or with", delete "among".

Column 4,
Line 13, after "material for", delete "the".
Line 45, after "and", insert -- the --.

Column 7,
Line 5, after "or", delete "a".
Line 36, after "view of", delete "a".

Column 8,
Line 13, delete "three", and insert therefor -- four --.

Column 9,
Line 65, after "invention that", delete "which".

Column 10,
Line 18, after "moveable", delete "across".
Line 39, delete first occurrence of "is".
Line 53, delete "to that", and insert therefor -- so that --.

Column 11,
Line 16, after "multilayered", insert -- fabric --.

UNITED STATES PATENT AND TRADEMARK OFFICE

CERTIFICATE OF CORRECTION

PATENT NO. : 6,158,366
DATED : December 12, 2000
INVENTOR(S) : Richard N. Codos

It is certified that error appears in the above-identified patent and that said Letters Patent is hereby corrected as shown below:

Column 13, claim 3,
Line 25, delete "needles bring", and insert therefor -- needles to bring --.

Column 14, claim 16,
Line 61, delete "the".

Column 14, claim 17,
Line 63, delete "wherein", and insert therefor -- further comprising --;
Line 64, delete the first occurrence of "the", and insert therefor -- a --.

Column 15, claim 23,
Line 40, delete "comprises", and insert therefor -- comprising --.

Signed and Sealed this

First Day of January, 2002

*Attest:*

*Attesting Officer*

JAMES E. ROGAN
*Director of the United States Patent and Trademark Office*